US007176771B2

(12) United States Patent
Faber et al.

(10) Patent No.: US 7,176,771 B2
(45) Date of Patent: Feb. 13, 2007

(54) CIRCUIT BREAKER FILTER ASSEMBLY

(75) Inventors: Timothy R. Faber, Marion, IA (US); Aymon A. Maulandi, Cedar Rapids, IA (US); Marc F. J. Rival, St Ismier (FR); David R. Pearson, Palo, IA (US)

(73) Assignee: Square D Company, Palatine, IL (US)

( * ) Notice: Subject to any disclaimer, the term of this patent is extended or adjusted under 35 U.S.C. 154(b) by 847 days.

(21) Appl. No.: 09/939,497

(22) Filed: Aug. 24, 2001

(65) Prior Publication Data

US 2003/0048586 A1 Mar. 13, 2003

(51) Int. Cl.
*H01H 33/04* (2006.01)

(52) U.S. Cl. ..... 335/201; 335/202

(58) Field of Classification Search ..... 361/200, 361/711, 694, 692, 695; 218/149, 156, 89, 218/157; 55/467, 497, 501, 502; 335/201, 335/202

See application file for complete search history.

(56) References Cited

U.S. PATENT DOCUMENTS

| | | | | | |
|---|---|---|---|---|---|
| 2,310,728 | A | | 2/1943 | Bartlett | 200/147 |
| 3,448,231 | A | * | 6/1969 | Heft | 218/89 |
| 3,812,370 | A | * | 5/1974 | LaViolette | 422/186.12 |
| 3,861,894 | A | * | 1/1975 | Marsh | 96/121 |
| 3,997,746 | A | * | 12/1976 | Harper et al. | 218/149 |
| 4,217,121 | A | * | 8/1980 | Fichter | 55/478 |
| 5,190,666 | A | * | 3/1993 | Bisconte | 210/744 |
| 5,600,411 | A | * | 2/1997 | Hart | 399/98 |
| 5,762,667 | A | * | 6/1998 | Pippel et al. | 55/473 |
| 5,795,361 | A | * | 8/1998 | Lanier et al. | 55/502 |
| 5,889,249 | A | | 3/1999 | Rival et al. | 218/149 |
| 6,125,841 | A | * | 10/2000 | Boudreault | 126/299 D |
| 6,218,636 | B1 | | 4/2001 | Blancfene et al. | 218/158 |
| 6,248,971 | B1 | | 6/2001 | Morel et al. | 218/157 |
| 6,494,940 | B1 | * | 12/2002 | Hak | 96/224 |
| 2002/0139741 | A1 | * | 10/2002 | Kopf | 210/224 |

FOREIGN PATENT DOCUMENTS

| | | |
|---|---|---|
| DE | 298 07 119 U1 | 6/1998 |
| EP | 0022708 B1 | 10/1983 |
| EP | 0 957 500 A1 | 11/1999 |
| FR | 1544434 | 10/1968 |

OTHER PUBLICATIONS

Abstract for EP 22708.

* cited by examiner

*Primary Examiner*—Donald Sparks

(57) ABSTRACT

An improved filter assembly for a circuit breaker includes a generally rectilinear filter housing having at least two filter mounting zones for receiving at least two filter assemblies, so as to define, in the aggregate, a filter assembly, and at least two filter assemblies configured for interfitting with the filter mounting zones of the filter housing, each filter assembly comprising a generally rectilinear filter body having a given peripheral configuration and a filter gasket configured for interfitting about a periphery of the filter body for sealingly engaging the filter body relative to the filter housing in response to forces encountered by the filter assembly both upon assembly and in operation. The filter assembly may further have a small hole diffuser having a peripheral configuration similar to the peripheral configuration of the filter bodies, in the aggregate, when assembled with the filter housing and configured for interfitting within the filter housing.

23 Claims, 8 Drawing Sheets

CIRCUIT BREAKER FILTER ASSEMBLY

FIELD OF THE INVENTION

This invention is directed generally to improvements in circuit breakers and more particularly to an improved circuit breaker arc chamber filter assembly and the manner of assembly thereof with an arc stack and breaker case.

BACKGROUND OF THE INVENTION

Low-voltage circuit breakers having high ratings generally utilize separable contacts arranged at the entry of an arc extinguishing chamber. When the contacts separate or open in response to a trip device following an overcurrent or the like, an electrical arc arises between the contacts. The arc extinguishing chamber is designed to absorb the energy of the arc while maintaining its voltage. Both the chamber and the separable contacts may be subject to high thermal, mechanical and electrical stresses. For example, a current of as much as 200,000 amperes may be maintained for 4 milliseconds at an arcing voltage of 500 volts, resulting in an energy of 400 kilojoules. The plasma column forming this arc can reach a temperature of as much as 4,000° to 20,000° Kelvin.

The arc extinguishing chamber includes a number of separators which are designed to break the arc down into fractions, enabling the voltage of the arc to be increased and the arc to be cooled by heat exchange with the separators. In addition to the separators, the arc chamber usually includes a filter assembly or a gas deionization device. This device may be designed as a porous shield arranged near an outlet orifice of the arc distinguishing chamber, such as a labyrinth-type of device formed by a plurality of shields with offset openings or windows.

It is important to ensure that all of the interruption gasses pass through the filters, avoiding leakage paths around the filter within the filter housing. That is, it is important to ensure that the gases within the filter housing do not pass around the actual filter elements.

Therefore, the deionization device or filter assembly and the separator assembly should be accurately assembled with each other and with the arc chamber formed in the circuit breaker housing, and held in place in proper alignment throughout the service life of the breaker, to assure that there is no significant "leakage" of arcing products around the separators and filter. Also, exposure of the arc plates or separators to heat and pressure from arc interruption can cause the plates to warp, causing a short circuit between adjacent plates, if touching. Accordingly, the assembly should provide structural integrity of the arc stack or separator assembly and filter assembly as well as sufficient support to withstand arcing forces.

In the present invention, we have also discovered a manner in which to construct the filter so as to increase the effective resistance of the filter and reduce the amount of leakage current during short circuits, so as to increase and maintain the interruption quality.

SUMMARY OF THE INVENTION

Briefly, in accordance with one aspect of the invention, An improved filter assembly for a circuit breaker comprises a generally rectilinear filter housing having at least two filter mounting zones for receiving at least two filter assemblies, so as to define, in the aggregate, a filter assembly, and at least two filter assemblies configured for interfitting with the filter mounting zones of the filter housing, each the filter assembly comprising a generally rectilinear filter body having a given peripheral configuration and a filter gasket configured for interfitting about a periphery of the filter body for sealingly engaging the filter body relative to the filter housing in response to forces encountered by the filter assembly both upon assembly and in operation.

In accordance with another aspect of the invention, a molded coarse hole diffuser for a filter assembly for use with a circuit breaker comprises a combined diffuser and spacer integrally molded as a single, one-piece unit, the coarse hole diffuser including means for engaging and interfitting with a filter housing in close overlying engagement with a small hole diffuser.

In accordance with another aspect of the invention, a circuit breaker assembly comprises a filter assembly comprising a generally rectilinear filter housing having at least two filter mounting zones for receiving at least two filter assemblies, so as to define, in the aggregate, a filter assembly, and at least two filter assemblies configured for interfitting with the filter mounting zones of the filter housing, each filter assembly comprising a generally rectilinear filter body having a given peripheral configuration and a filter gasket configured for interfitting about a periphery of the filter body for sealingly engaging the filter body relative to the filter housing in response to forces encountered by the filter assembly both upon assembly and in operation, a small hole diffuser having a peripheral configuration similar to the peripheral configuration of the filter bodies, in the aggregate, when assembled with the filter housing and configured for interfitting within the filter housing, superimposed over the filter assemblies, a spacer interposed between the filters and the small hole diffuser, and a molded coarse hole diffuser, defining a combined diffuser and spacer integrally molded as a single, one-piece unit, the coarse hole diffuser including means for engaging and interfitting with the filter housing in close overlying engagement with the small hole diffuser.

In accordance with another aspect of the invention, a method of filtering high energy arcing in a circuit breaker comprises mounting at least two filter assemblies with a generally rectilinear filter housing having at least two filter mounting zones so as to define, in the aggregate, a filter assembly, and sealingly engaging the filter body relative to the filter housing in response to forces encountered by the filter assembly both dining assembly and in operation.

In accordance with another aspect of the invention, a method of suppressing arcing in a circuit breaker comprises filtering a high energy arc comprising mounting at least two filter assemblies with a generally rectilinear filter housing having at least two filter mounting zones so as to define, in the aggregate, a filter assembly, sealingly engaging the filter body relative to the filter housing in response to forces encountered by the filter assembly both dining assembly and in operation, assembling a small hole diffuser having a peripheral configuration similar to the peripheral configuration of the filter bodies in the aggregate, when assembled, with the filter housing and interfitting within the filter housing superimposed over the filter assemblies, interposing a spacer between the filters and the small hole diffuser, and engaging a molded coarse hole diffuser, defining a combined diffuser and spacer integrally molded as a single, one-piece unit, with the filter housing in close overlying engagement with the small hole diffuser, and a method for diffusing the arc, comprising positioning and maintaining the arc stack and the filter assembly in assembled relation within the breaker housing, including maintaining compression on the gaskets and maintaining constant assembly force upon the assembly, equalizing compression loading of the gaskets and providing final positioning of the arc stack and filter assembly into the breaker case, utilizing complementary projections and slots formed respectively on the arc stack, the coarse hole diffuser and the breaker housing.

In accordance with another aspect of the invention, a filter assembly comprises means for mounting at least two filter assemblies with a generally rectilinear filter housing having at least two filter mounting zones so as to define, in the aggregate, a filter assembly, and means for sealingly engaging the filter body relative to the filter housing in response to forces encountered by the filter assembly both dining assembly and in operation.

In accordance with another aspect of the invention, a circuit breaker assembly comprises means for filtering a high energy arc comprising means for mounting at least two filter assemblies with a generally rectilinear filter housing having at least two filter mounting zones so as to define, in the aggregate, a filter assembly, means for sealingly engaging the filter body relative to the filter housing in response to forces encountered by the filter assembly both dining assembly and in operation, means for assembling a small hole diffuser having a peripheral configuration similar to the peripheral configuration of the filter bodies in the aggregate, when assembled, with the filter housing and interfitting within the filter housing, superimposed over the filter assemblies, means for interposing a spacer between the filters and the small hole diffuser, and means for engaging a molded coarse hole diffuser, defining a combined diffuser and spacer integrally molded as a single, one-piece unit, with the filter housing in close overlying engagement with the small hole diffuser, and means for diffusing the arc, comprising means for positioning and maintaining the arc stack and the filter assembly in assembled relation within the breaker housing, including maintaining compression on the gaskets and maintaining constant assembly force upon the assembly, equalizing compression loading of the gaskets and providing final positioning of the arc stack and filter assembly into the breaker case.

DETAILED DESCRIPTION OF THE ILLUSTRATED EMBODIMENT

Figure 1:
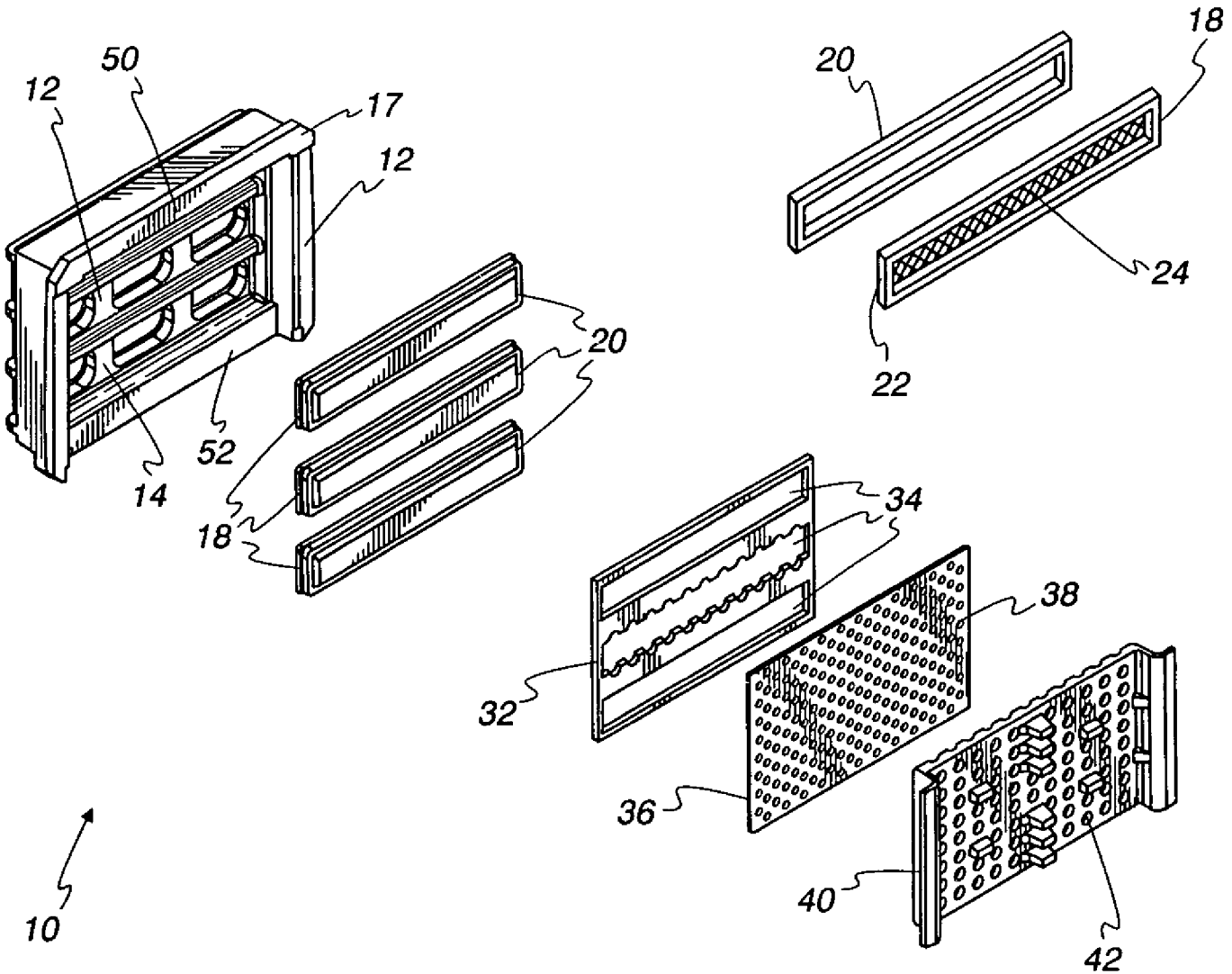
FIG. 1 is an exploded isometric view of a filter assembly in accordance with one aspect of the invention.

Referring to the drawings, and initially to FIG. 1, an improved circuit breaker arc chamber filter assembly is illustrated, and indicated generally by the reference numeral 10. The assembly 10 includes a filter frame or filter cup element 12 which has one or more generally rectilinear recesses 14, 16, for receiving complementary generally rectilinear shaped filter elements 18, each of which is additionally provided with a sealing gasket 20. As best viewed in FIG. 2, both the gaskets 20 and filter elements 18 interfit within the recesses 14, 16 and 17 of the filter cup or housing 12 so as to promote sealing engagement of the gaskets 20 between opposed and facing surfaces 28, 30 of the housing or cup 12 and the filter elements 20.

In accordance with one aspect of the invention, each of the filters 18 is separately mounted within an associated recess of the housing or cup 12 to define or provide a composite filter. Advantageously, by separating the filter into multiple pieces (three in the illustrated embodiment) the effective resistance is increased as the conductive path between the filter elements is broken by the nonconductive material of the housing or cup 12 as well as frame portions 22 of each filter element 18. This reduces the amount of leakage current during short circuits. The filter material 24 of each filter element 18 may comprise a wire mesh material, for example of the type described in U.S. Pat. No. 5,889,249.

Figure 2:
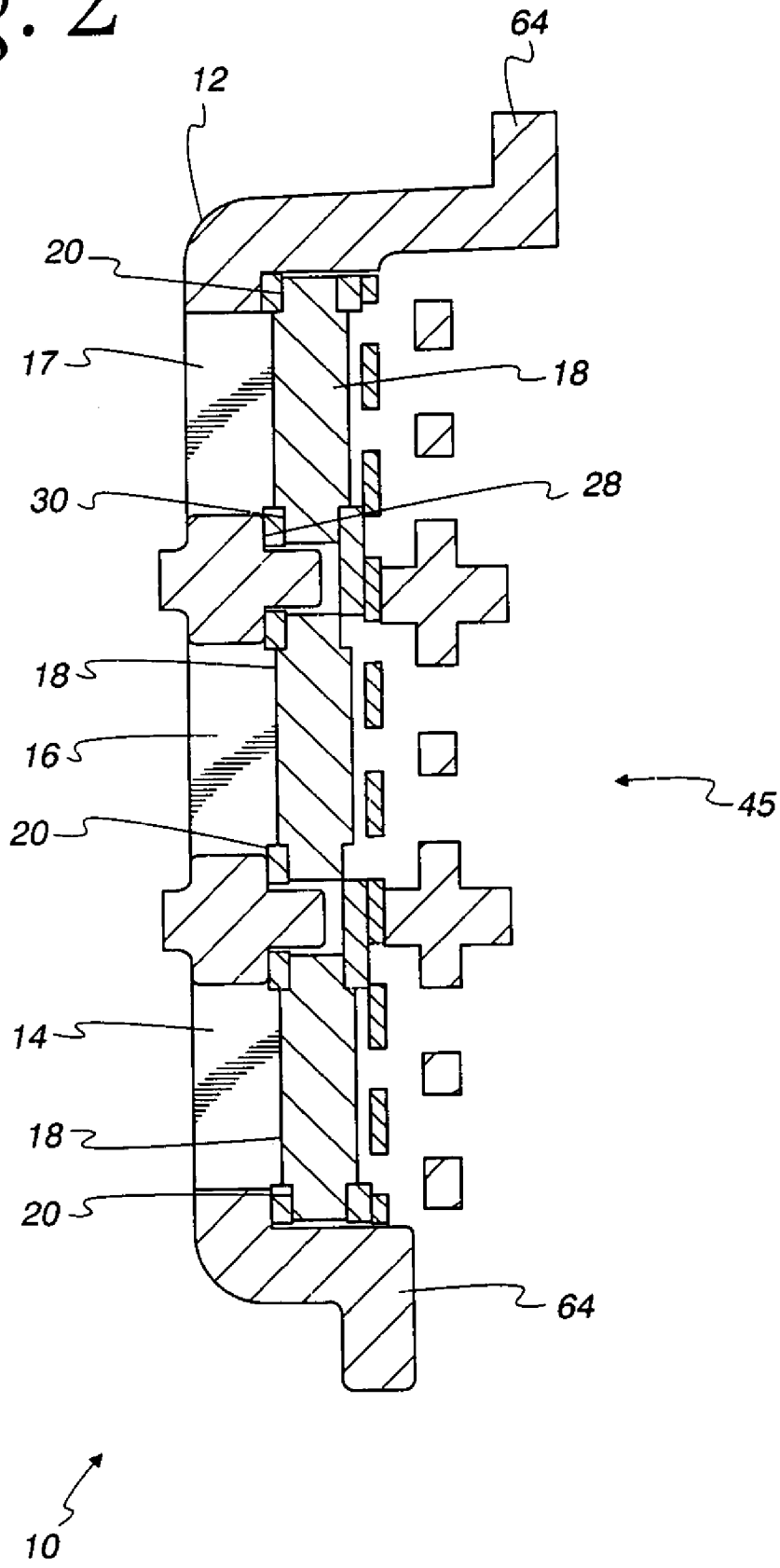
FIG. 2 is a sectional elevation through the assembled structure of FIG. 1.

With respect to the sealing of the gasket 20, as best viewed in FIG. 2, each filter element 18 has peripheral recess portion 30 which is of a complementary shape for interfitting with the generally rectilinear, open-centered gasket 20. The gasket 20 may be comprised of a suitable silicone or other rubber or rubber-like sealing material.

Superimposed over the filter elements 18 is a frame-like spacer element 32 which has through openings or cutouts 34 sized for interfitting about the peripheries of the respective filter elements 18. The facing surfaces of the filtering elements 18 are provided with similar recessed peripheral surfaces or edges for interfitting with these cutouts 34 as best viewed in FIG. 2.

A small hole diffuser plate 36 is superimposed over the spacer 32 and is provided with a plurality of through openings or holes 38 in a grid-like arrangement. A combined coarse hole diffuser plate, spacer and flange member 40 overlies the small hole diffuser 36. The coarse hole diffuser 40 has a plurality of through openings or holes 42 which are of somewhat larger diameter than the openings 38 and are arranged in a grid-like pattern, offset from the holes 38.

Figure 3:
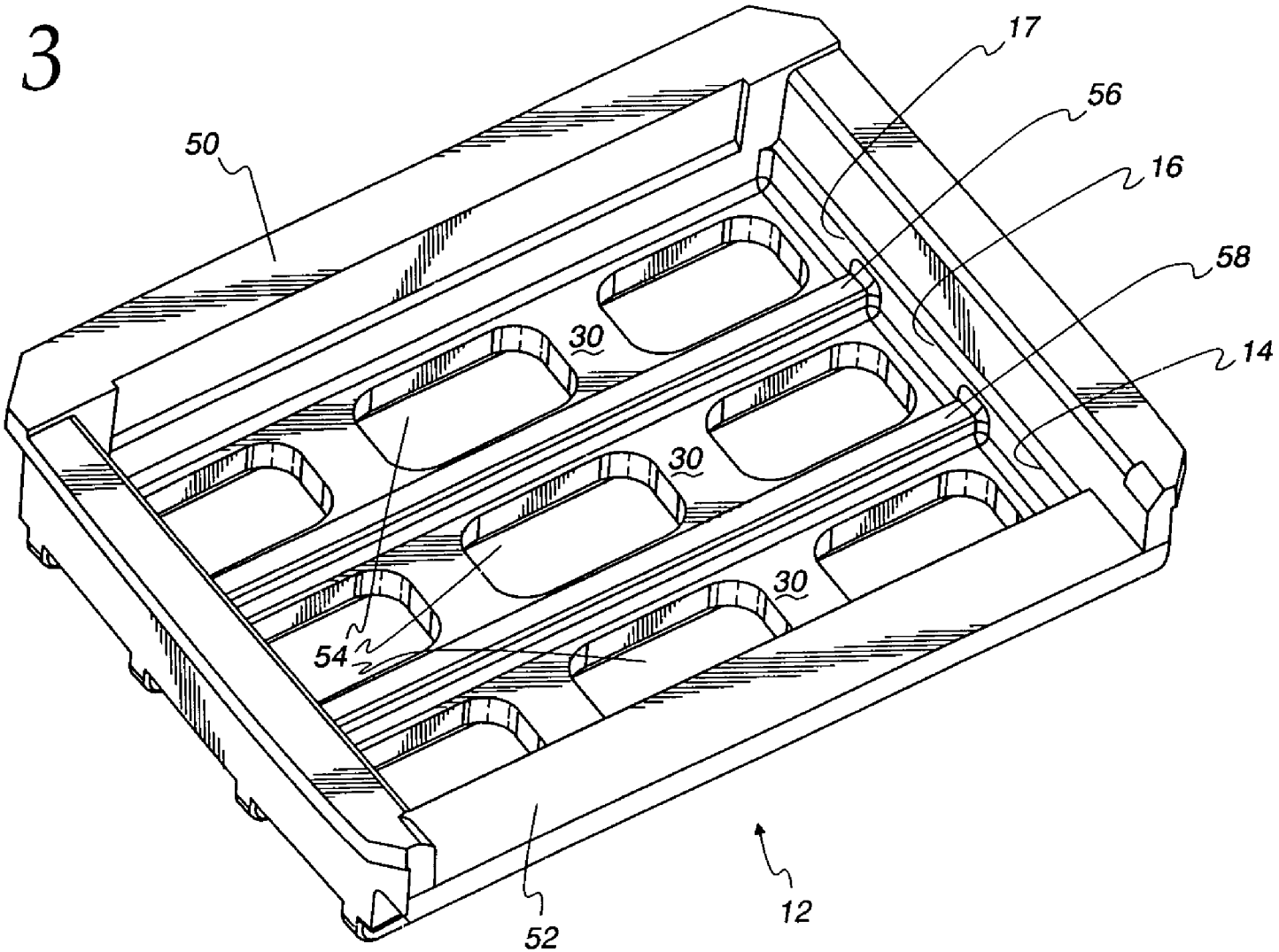
FIGS. 3 and 4 are respective top and bottom isometric views of a filter housing portion of the assembly of FIGS. 1 and 2.
Figure 4:
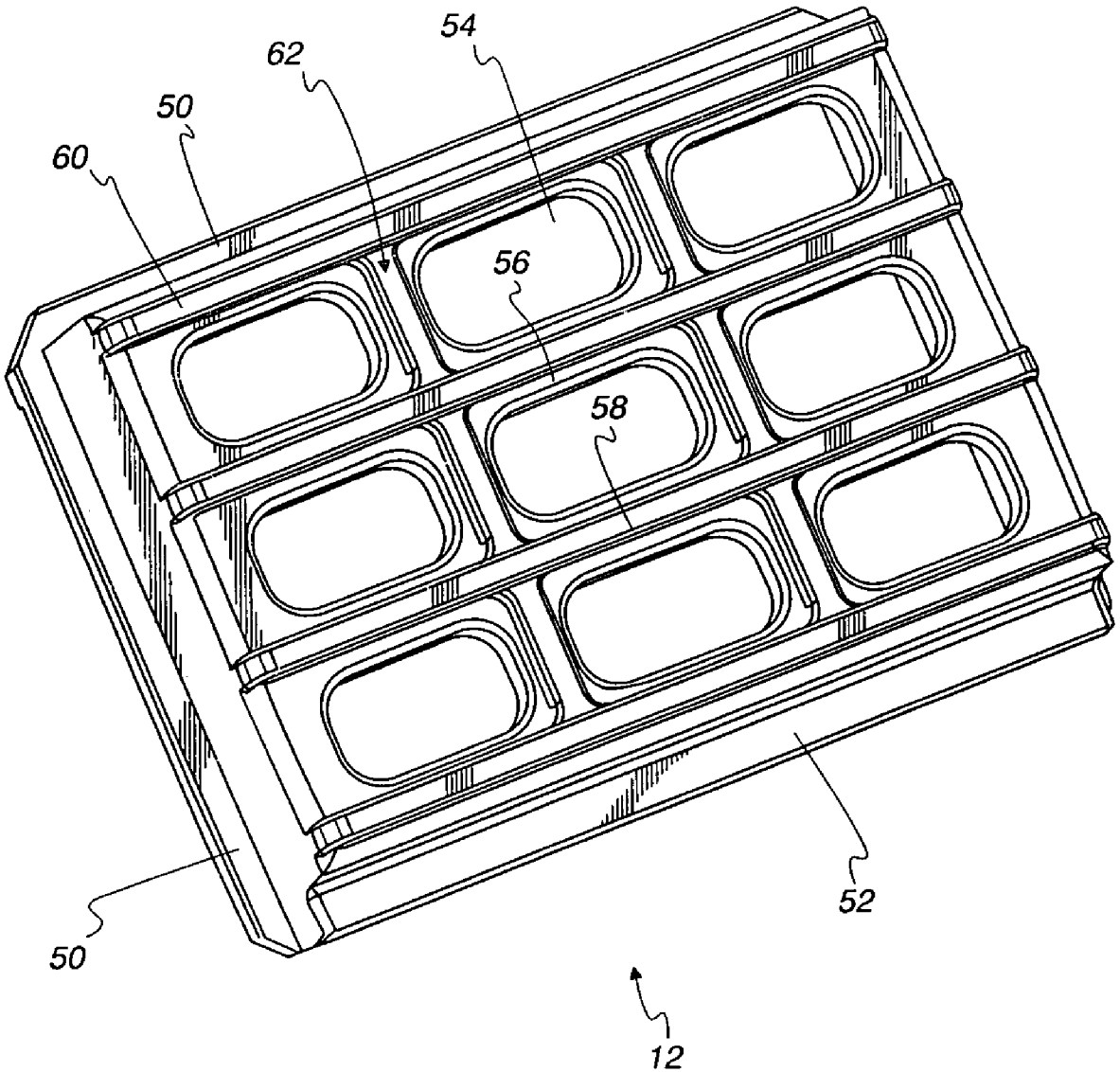

Referring now to FIGS. 3 and 4, front and rear isometric views of the filter frame or filter cup element 12 further illustrate the various portions thereof, including the recesses 14, 16 and 17. The filter cup or housing also includes a frame-like peripheral rim 50 which extends about three sides thereof, with the fourth side being somewhat recessed somewhat as indicated at reference numeral 52. Each of the recesses 14, 16 and 17 has a plurality of through openings 54. The recesses 14, 16 and 17 are further defined by intermediate walls or separators 56, 58. Additional supporting structure of the one-piece, integrally molded filter frame or cup element 12 includes horizontal and vertical stiffener walls or surfaces 60, 62.

Figure 5:
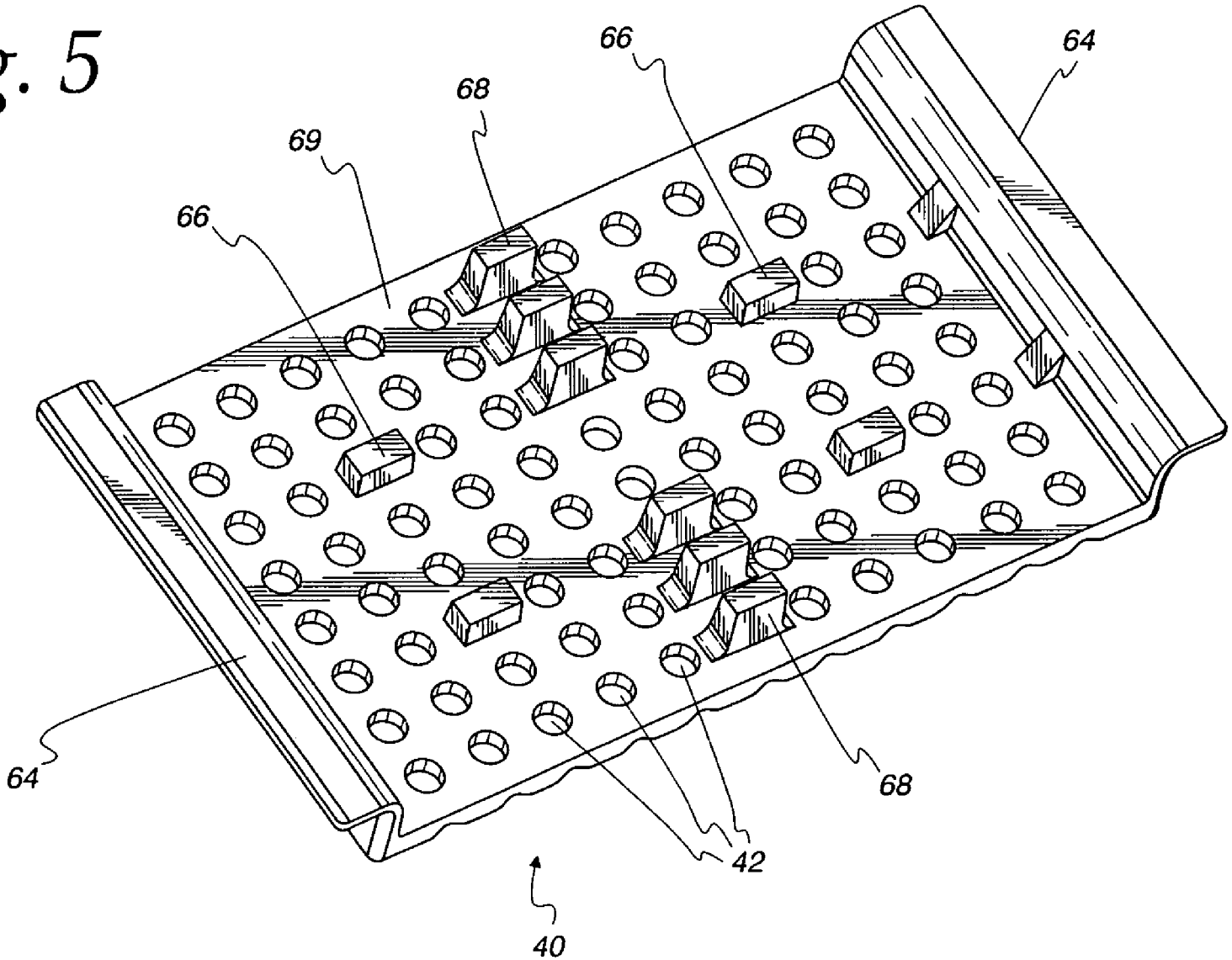
FIG. 5 is an enlarged isometric view of a coarse hole diffuser portion of the assembly of FIGS. 1 and 2.
Figure 6:
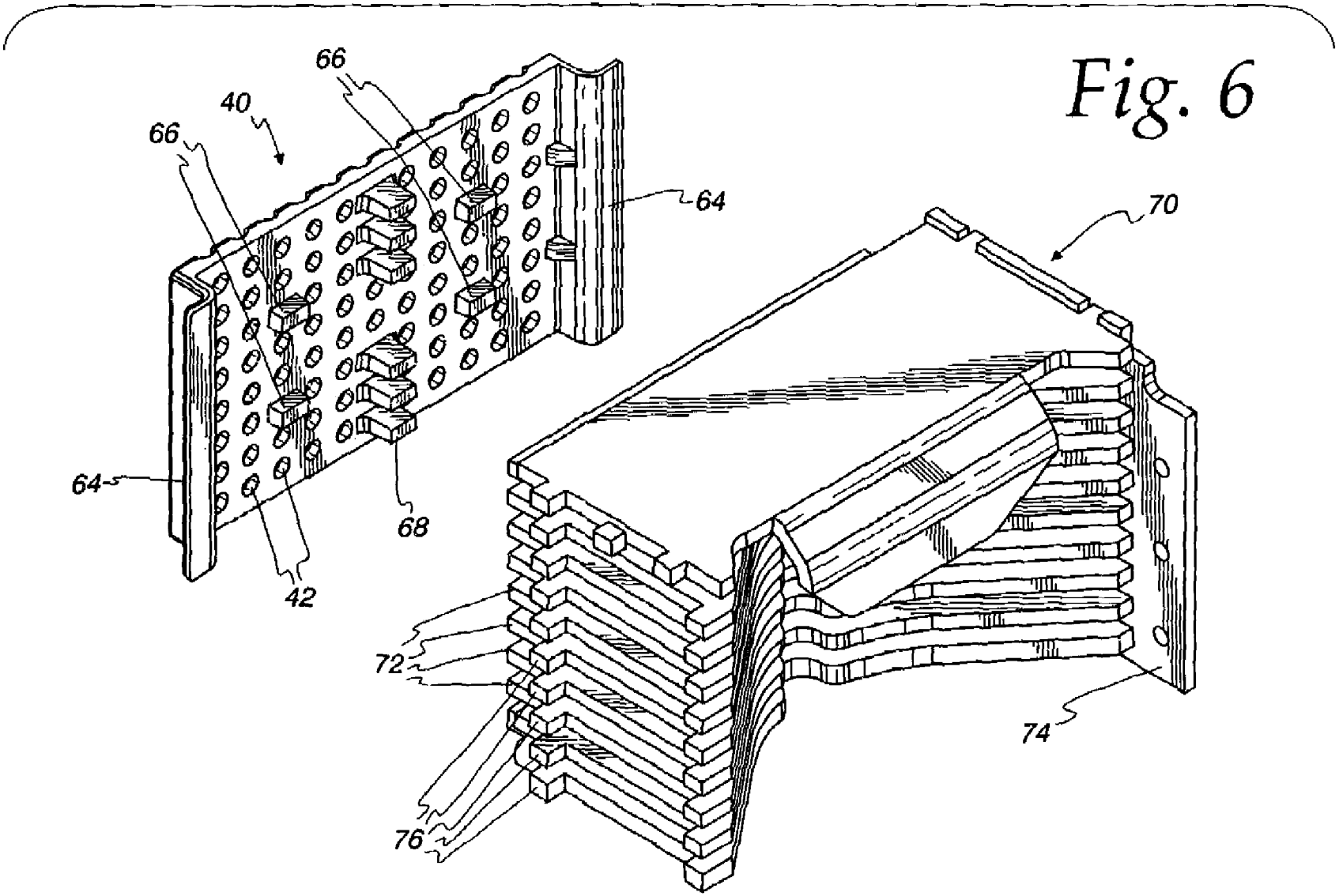
FIG. 6 is an isometric view showing cooperative structural features of the coarse hole diffuser of FIG. 5 and an arc stack assembly, in accordance with one aspect of the invention.
Figure 7:
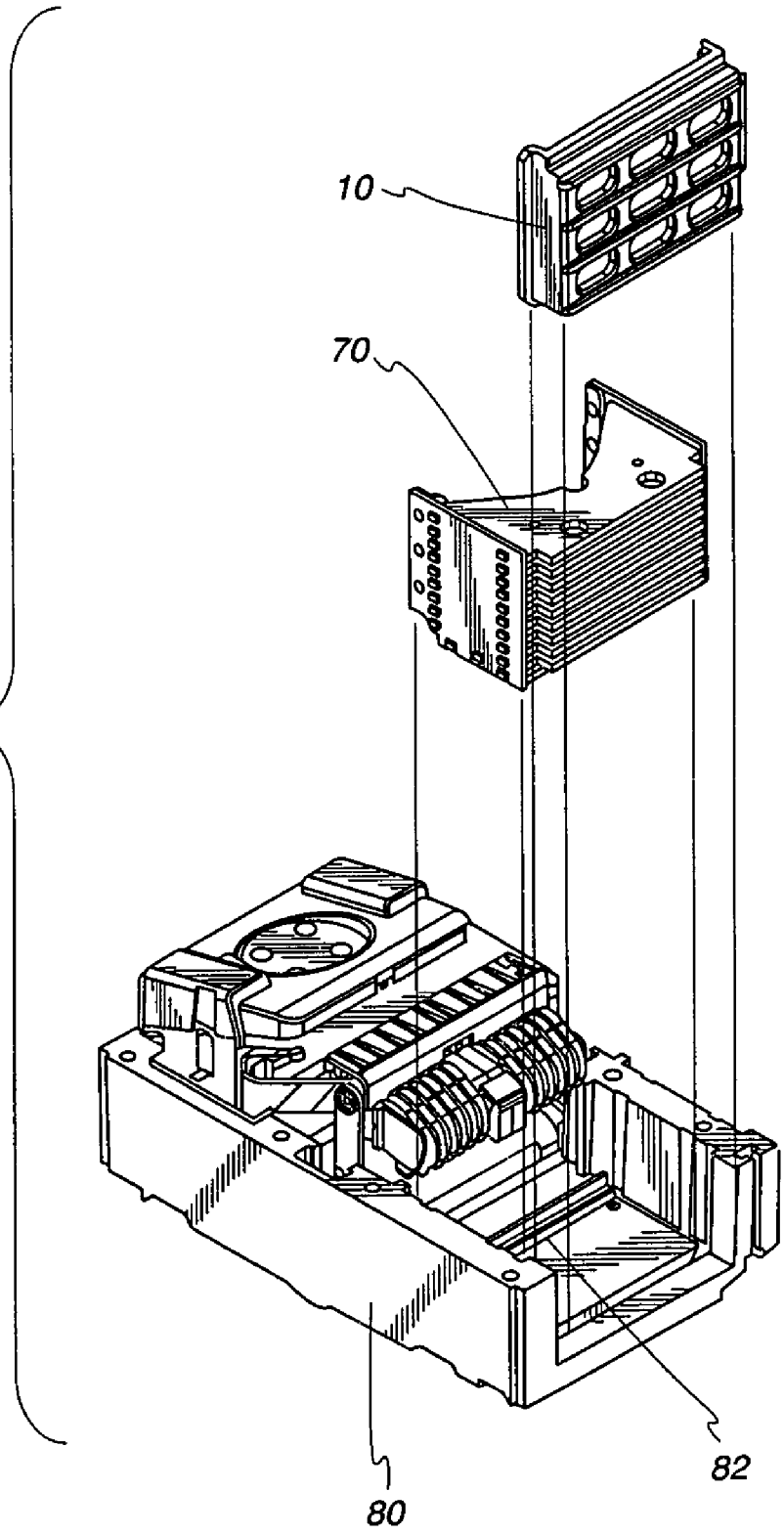
FIG. 7 is an isometric view illustrating assembly of the arc stack assembly and filter assembly with a breaker case in accordance with one aspect of the invention.
Figure 8:
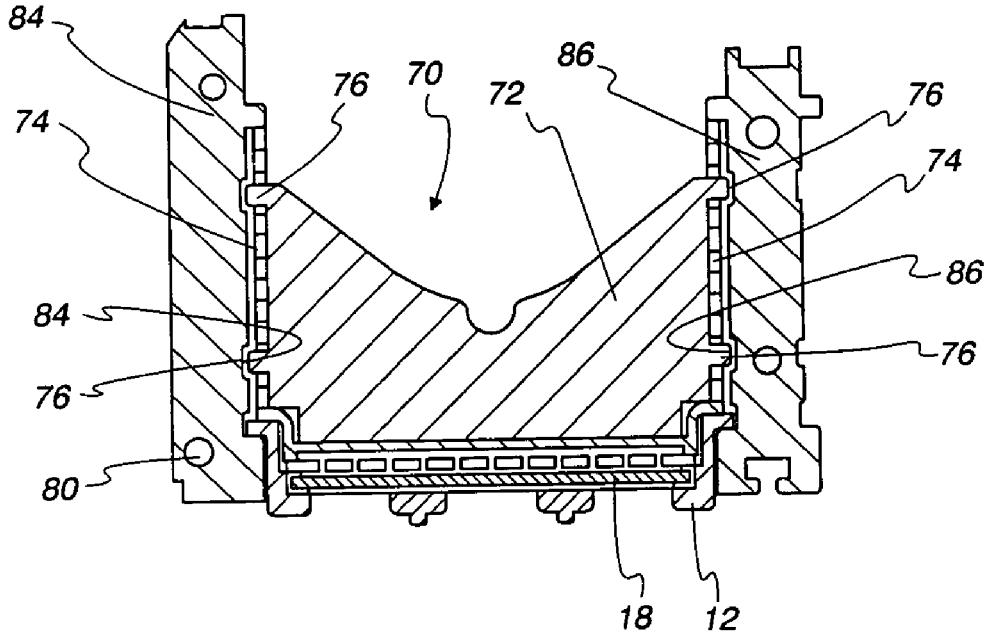
FIGS. 8 and 9 are partial sectional views showing assembly of the arc stack and filter assembly with a cover and base portion of a circuit breaker assembly.
Figure 9:
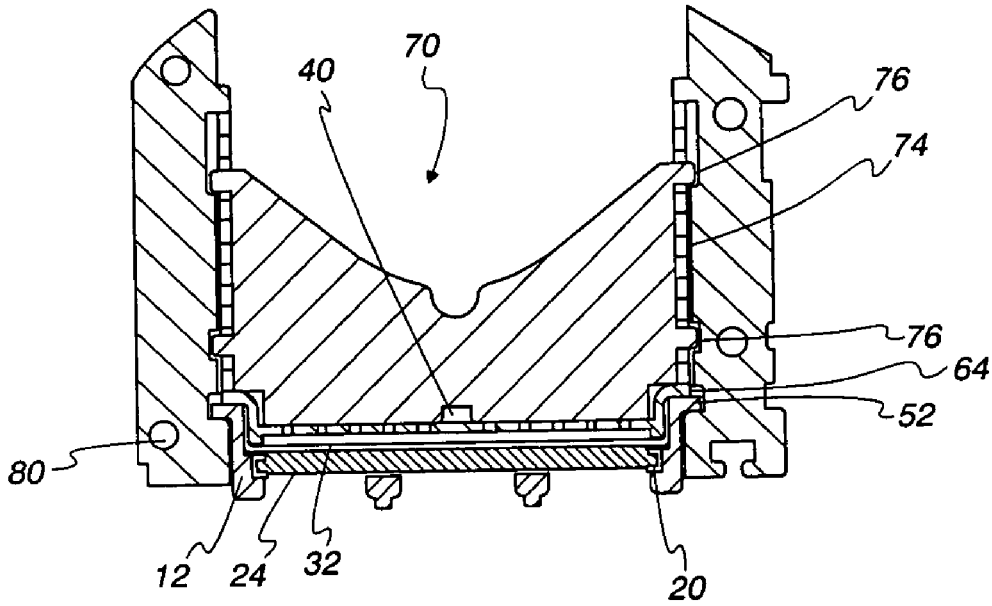

Referring now to FIGS. 5 and 6, the coarse hole diffuser 40 is shown in further detail. This one piece, integrally molded coarse hole diffuser element combines the functions of coarse hole diffuser plate, spacer and a flange for accomplishing alignment, and positioning of the coarse hole diffuser. This alignment includes positioning the openings 42 in the suitable and desired offset relationship with the openings 38 of the small hole diffuser plate 36, as well as aligning the diffuser 40 with the plates 72 of the arc stack assembly 70 shown in FIG. 6, to be further described presently. In this regard, the diffuser 40 includes peripheral flanges 64 which extend along lateral opposed edges thereof and which cooperatively interfits with the corresponding lateral side edge portions of the peripheral flange 50 of the frame or cup element 12, as best viewed in FIGS. 8 and 9. These peripheral flanges 64 also interfit with corresponding tapered grooves or slots 82 which are formed in the breaker housing or case 80, so as to accommodate, align and position the filter assembly 10 with respect to the arc stack assembly 70. This arrangement also provides appropriate forces for sealing engagement of the silicone gaskets 20 between the filter elements and facing surfaces in the recesses of the housing or cup 12, upon completion of the assembly as indicated respectively in FIGS. 7, 8 and 9.

Referring again to FIGS. 5 and 6, the diffuser element 40 also includes a number of projecting locater elements or embossments 66 and a plurality of parallel and spaced projecting arc plate spacers or protruding embossments 68. In the embodiment illustrated, the locater projections 66 are four in number and are located so as to define four corners of a rectangle which is generally congruent with and centered with respect to the rectangular space defined by the diffuser plate 40, and on the surface 69 thereof which bears the openings or holes 42. Similarly, the arc plate spacer projections 68 project from this surface 69 along a horizontal centerline thereof in a generally vertically spaced and parallel array. These latter spacers 68, in the illustrated embodiment, are six in number with three being located in generally symmetrical fashion to either side of a vertical center of the surface 69.

Referring now to FIG. 6, the arc stack assembly 70 will be seen to comprise a plurality of parallel and spaced apart aligned arc plates 72. These plates are retained in the alignment indicated in FIG. 6 by respective side plates 74, only one of which is seen in FIG. 6, the other having been broken away to permit a view of the edge surfaces of the arc plates 72. Each of these edges includes a pair of spaced apart arc plate protrusions or projections 76 which are used to align the plates with, and interfit with, the side plates 74, and also project somewhat outwardly of the side plates 74 to interfit with cooperating tapered locating slots or grooves 84, 86 in the side walls of the breaker case or housing 80. The manner in which the arc plate spacers 68, which are of a dielectric material as is the rest of the diffuser 40, interfit with the electrically conductive material of the arc plates 72 is indicated in FIG. 6. The alignment locator embossments 66 also interfit between selected ones of the arc plates 72 so as to further locate and maintain the diffuser element 40 in a secure assembled, aligned relation with the arc stack assembly 70, e.g., opposing tilting or rotational improvement.

The illustrated embodiment of the invention described hereinabove achieves a number of performance advantages including the following:

1. Improved high voltage performance. The invention improves performance at high voltage levels by separating the filters into multiple components in the direction perpendicular to the arc voltage. In this manner amount of current flowing in the filter proper during short circuits is reduced. This is because the filter, being of conductive material, will carry current roughly equivalent to the arc voltage divided by the average resistance of the filter mesh if it is made of one piece. In separating the filter into multiple pieces (two, three, or more) the effective resistance is increased as the conductive path between the pieces is broken by non-conductive material. This reduces the amount of leakage current during short circuits that can lead to a degradation in interruption quality.

2. Integrated sealing. Key to obtaining the benefits of this filter technology is to insure that all interruption gases pass through the filters. This is accomplished by a two stage system in which the first stage is a lip designed into the filter housing that coordinates with the breaker enclosure to insure that leakage around the filter housing is minimized. The second stage is to insure that gases within the filter housing do not pass around the filter elements. To this end, gasket elements have been added to the filter elements in such a manner so as to obtain a seal between the filter housing and the filter elements. Compression of these gaskets for effective sealing is initially achieved by the combined thickness of the filter components themselves being slightly thicker than the available space and ultimately by the use of the active sealing technique described below.

3. Active sealing. During the interruption, the production of heated gases creates a positive pressure gradient between the breaker arc chamber and the exterior of the device. This gradient causes a high velocity gas flow through the filter system. The resistance to this gas flow offered by the filter system creates an effective force tending generally toward the exterior of the breaker. This force is used in such a way as to compress the primary seals between the filter elements and the filter housing in such a way as to be self sealing. This behavior is intentional and the invention has been designed to exploit it.

4. Molded coarse hole diffuser. A molded diffuser is added to the prefilter treatment stages of the assembly. Current products typically use two successive diffuser plates using alternating hole patterns to create a non-direct ablative path for the interruption gases. In this invention, the first diffuser plate has been replaced with a molded piece that provides all the functionality of the plate but also incorporates alignment, spacing (keeps the plates apart) and insulating (protects corners of steel filter cup) functions. It does this in coordination with the filter cup and arc stack assembly.

5. Improved performance at high interrupting current levels. Integration of the arc stack assembly with the filter assembly, and the breaker case (base and cover) provide structural integrity of the arc stack assembly by utilizing a series of protrusions on the arc plates and molded slots in the base and cover. The molded slots in the base and cover combined with minimal clearance of the arc stack side plates and base walls limit the lateral movement of the arc stack assembly. The limited displacement of the arc stack assembly maintains the relative position of the arc plates, eliminating any potential to disengage the arc plates from the side plates by pressure induced on the arc stack during interruption. The interface between the arc stack assembly and filter assembly provide additional support for the arc plates by means of molded protrusions in the coarse hole diffuser. These protrusions are nominally the width of the arc plate spacing and are inserted between the arc plates to provide support. Arc plates exposed to heat and pressure from arc interruption potentially cause the plates to warp touching the adjacent plate creating a short circuit. Compression of the silicone gaskets in the filter assembly takes up any assembly clearance when assembling arc stack assembly/filter assembly to the cover and maintains constant assembly force.

Assembly of the base equalizes compression loading of the silicone gaskets while providing final positioning of the arc stack/filter assembly into the breaker case.

6. Improved assembly of components. Tapered slots in the breaker case (base and cover) allow location for loose drop-in Z axis assembly of the arc stack/filter assembly into the cover. Tapered slots in the base create lead-in features over the arc stack/filter assembly when assembling base to cover. The limited displacement of the arc stack assembly in the breaker case require only minimal staking of the arc plates to secure the arc stack assembly prior to installation.

7. Increase in interruption voltage capabilities. Reduction in gas leakage and corresponding potential for cross phase and strike to ground. Reduction in enclosure sizes and distances to ungrounded or conductive metal. Simplified assembly and better alignment of components.

8. No structural staking of arc stack assembly required, only minimal staking required for assembly and handling. No incidence of arc stack plate disengagement has been observed with minimal assembly staking. No incidence of arc plate collapse has been observed with use of coarse hole diffuser support protrusions.

While particular embodiments and applications of the present invention have been illustrated and described, it is to be understood that the invention is not limited to the precise construction and compositions disclosed herein and that various modifications, changes, and variations may be apparent from the foregoing descriptions without departing from the spirit and scope of the invention as defined in the appended claims.

What is claimed is:

1. An improved filter assembly for a circuit breaker comprising:

a filter housing having at least two filter mounting zones for receiving at least two filter assemblies, so as to define, in the aggregate, a filter assembly; and at least two filter assemblies configured for interfitting with said filter mounting zones of said filter housing, each said filter assembly comprising a filter body having a given peripheral configuration and a filter gasket configured for interfitting about a periphery of said filter body for sealingly engaging said filter body relative to said filter housing in response to forces encountered by said filter assembly both upon assembly and in operation;

wherein each of said filter bodies has a peripheral recessed portion for positioning, mounting and bearing against a complementary edge portion of said filter gasket; and a small hole diffuser having a peripheral configuration similar to the peripheral configuration of said filter bodies, in the aggregate, when assembled with said filter housing and configured for interfitting within said filter housing, superimposed over said filter assemblies;

a spacer interposed between said filters and said small hole diffuser; and a molded coarse hole diffuser, defining a combined diffuser and spacer integrally molded as a single, one-piece unit, said coarse hole diffuser including means for engaging and interfitting with said filter housing in close overlying engagement with said small hole diffuser.

2. The assembly of claim 1 wherein said coarse hole diffuser further includes means for cooperatively interfitting with a plurality of arc plates of an arc diffuser plate assembly, including means for locating and engaging said coarse hole diffuser relative to said arc plate assembly and means for engaging and maintaining a plurality of plates of said arc plate assembly in parallel and spaced apart condition.

3. The assembly of claim 2 in combination with a circuit breaker housing and arc stack, and further including complementary projections and slots formed respectively on said arc stack, said coarse hole diffuser and said breaker housing for positioning and maintaining said arc stack and said filter assembly in assembled relation within said breaker housing, including maintaining compression on said gaskets and maintaining constant assembly force upon said assembly, equalizing compression loading of said gaskets and providing final positioning of the arc stack and filter assembly into the breaker case.

4. An improved filter assembly for a circuit breaker comprising:

a filter housing having at least two filter mounting zones for receiving at least two filter assemblies, so as to define, in the aggregate, a filter assembly; and at least two filter assemblies configured for interfitting with said filter mounting zones of said filter housing, each said filter assembly comprising a filter body having a given peripheral configuration and a filter gasket configured for interfitting about a periphery of said filter body for sealingly engaging said filter body relative to said filter housing in response to forces encountered by said filter assembly both upon assembly and in operation;

wherein said filter housing comprises a frame-like, one-piece molded member having a recessed area for receiving each of said filter elements and an associated gasket therewithin, including separate areas for cooperatively interfitting with and bearing against edges of said gaskets opposite edges thereof bearing against said filter elements, and a projecting frame-like peripheral portion extending outwardly for surrounding engagement with said filter elements, said spacer and said small hole diffuser.

5. The assembly of claim 4 wherein said coarse hole diffuser further includes a peripheral flange at least along portions of a periphery thereof for engaging with and seating relative to a complementary peripheral flange portion of said filter housing.

6. A molded coarse hole diffuser for a filter assembly for use with a circuit breaker, said molded coarse hole diffuser comprising a combined coarse hole diffuser and spacer integrally molded as a single, one-piece unit, said coarse hole diffuser including means for engaging and interfitting with a filter housing in close overlying engagement with a small hole diffuser.

7. The diffuser of claim 6 wherein said coarse hole diffuser further includes means for cooperatively interfitting with a plurality of arc plates of an arc diffuser plate assembly, including means for locating and engaging said coarse hole diffuser relative to said arc plate assembly and means for engaging and maintaining a plurality of plates of said arc plate assembly in parallel and spaced apart condition.

8. The diffuser of claim 6 wherein said coarse hole diffuser further includes a peripheral flange at least along portions of the periphery thereof for engaging with and seating relative to a complementary peripheral flange portion of said filter housing.

9. The diffuser of claim 8 in combination with a circuit breaker housing and arc stack, and further including complementary projections and slots formed respectively on said arc stack, said coarse hole diffuser and said breaker housing for positioning and maintaining said arc stack and a filter assembly in assembled relation within said breaker housing, including maintaining compression on said gaskets and maintaining constant assembly force upon said assembly, equalizing compression loading of said gaskets and providing final positioning of the arc stack and filter assembly into the breaker case.

10. A circuit breaker assembly comprising:

a filter housing having at least two filter mounting zones for receiving at least two filter assemblies, so as to define, in the aggregate, a filter assembly;

at least two filter assemblies configured for interfitting with said filter mounting zones of said filter housing, each said filter assembly comprising a filter body having a given peripheral configuration and a filter gasket configured for interfitting about a periphery of said filter body for sealingly engaging said filter body relative to said filter housing in response to forces encountered by said filter assembly both upon assembly and in operation;

a small hole diffuser having a peripheral configuration similar to the peripheral configuration of said filter bodies, in the aggregate, when assembled with said filter housing and configured for interfitting within said filter housing, superimposed over said filter assemblies;

a spacer interposed between said filters and said small hole diffuser; and a molded coarse hole diffuser, defining a combined diffuser and spacer integrally molded as a single, one-piece unit, said coarse hole diffuser including means for engaging and interfitting with said filter housing in close overlying engagement with said small hole diffuser.

11. The assembly of claim 10 in combination with a circuit breaker housing and an arc stack, and further including complementary projections and slots formed respectively on said arc stack, said coarse hole diffuser and said breaker housing for positioning and maintaining said arc stack and said filter assembly in assembled relation within said breaker housing, including maintaining compression on said gaskets and maintaining constant assembly force upon said assembly, equalizing compression loading of said gaskets and providing final positioning of the arc stack and filter assembly into the breaker case.

12. A method of filtering high energy arcing in a circuit breaker comprising:

mounting at least two filter assemblies with a filter housing having at least two filter mounting zones so as to define, in the aggregate, a filter assembly; sealingly engaging said filter body relative to said filter housing in response to forces encountered by said filter assembly both during assembly and in operation;

assembling a small hole diffuser having a peripheral configuration similar to the peripheral configuration of said filter bodies in the aggregate, when assembled, with said filter housing, and interfitting within said filter housing superimposed over said filter assemblies;

interposing a spacer between said filters and said small hole diffuser; and engaging a molded coarse hole diffuser, defining a combined diffuser and spacer integrally molded as a single, one-piece unit, with said filter housing in close overlying engagement with said small hole diffuser.

13. The method of claim 12 further including cooperatively interfitting said coarse hole diffuser with a plurality of arc plates of an arc diffuser plate assembly, including locating and engaging said coarse hole diffuser relative to said arc plate assembly so as to engage and maintain a plurality of plates of said arc plate assembly in parallel and spaced apart condition.

14. A method of filtering high energy arcing in a circuit breaker comprising:

mounting at least two filter assemblies with a filter housing having at least two filter mounting zones so as to define, in the aggregate, a filter assembly; and sealingly engaging said filter body relative to said filter housing in response to forces encountered by said filter assembly both during assembly and in operation; and wherein said mounting comprises receiving filter elements and gaskets within a recessed area of a frame-like, one-piece molded member comprising said filter housing, including cooperatively interfitting with and bearing against edges of said gaskets opposite edges thereof bearing against said filter elements, and said filter housing surroundingly engaging said filter elements, said spacer and said small hole diffuser.

15. The method of claim 14 further including engaging and seating a peripheral flange of said coarse hole diffuser relative to a complementary peripheral flange portion of said filter housing.

16. The method of claim 13 and further including positioning and maintaining said arc stack and said filter assembly in assembled relation within said breaker housing, including maintaining compression on said gaskets and maintaining constant assembly force upon said assembly, equalizing compression loading of said gaskets and providing final positioning of the arc stack and filter assembly into the breaker case, utilizing complementary projections and slots formed respectively on said arc stack, said coarse hole diffuser and said breaker housing.

17. A method of suppressing arcing in a circuit breaker comprising:

a method filtering a high energy arc comprising:

mounting at least two filter assemblies with a filter housing having at least two filter mounting zones so as to define, in the aggregate, a filter assembly;

sealingly engaging said filter body relative to said filter housing in response to forces encountered by said filter assembly both dining assembly and in operation;

assembling a small hole diffuser having a peripheral configuration similar to the peripheral configuration of said filter bodies in the aggregate, when assembled, with said filter housing and interfitting within said filter housing superimposed over said filter assemblies;

interposing a spacer between said filters and said small hole diffuser; and engaging a molded coarse hole diffuser, defining a combined diffuser and spacer integrally molded as a single, one-piece unit, with said filter housing in close overlying engagement with said small hole diffuser; and a method for diffusing said arc, comprising:

positioning and maintaining said arc stack and said filter assembly in assembled relation within said breaker housing, including maintaining compression on said gaskets and maintaining constant assembly force upon said assembly, equalizing compression loading of said gaskets and providing final positioning of the arc stack and filter assembly into the breaker case, utilizing complementary projections and slots formed respectively on said arc stack, said coarse hole diffuser and said breaker housing.

18. A filter assembly comprising:

means for mounting at least two filter assemblies with a filter housing having at least two filter mounting zones so as to define, in the aggregate, a filter assembly;

means for sealingly engaging said filter body relative to said filter housing in response to forces encountered by said filter assembly both dining assembly and in operation;

means for assembling a small hole diffuser having a peripheral configuration similar to the peripheral configuration of said filter bodies in the aggregate, when assembled with said filter housing, and for interfitting within said filter housing superimposed over said filter assemblies;

means for interposing a spacer between said filters and said small hole diffuser; and means for engaging a molded coarse hole diffuser, defining a combined diffuser and spacer integrally molded as a single, one-piece unit, with said filter housing in close overlying engagement with said small hole diffuser.

19. The assembly of claim 18 further including means for cooperatively interfitting said coarse hole diffuser with a plurality of arc plates of an arc diffuser plate assembly, including means for locating and engaging said coarse hole diffuser relative to said arc plate assembly so as to engage and maintain a plurality of plates of said arc plate assembly in parallel and spaced apart condition.

20. The assembly of claim 19 and further including means for positioning and maintaining said arc stack and said filter assembly in assembled relation within said breaker housing, including means for maintaining compression on said gaskets and maintaining constant assembly force upon said assembly, for equalizing compression loading of said gaskets and for providing final positioning of the arc stack and filter assembly into the breaker case.

21. A filter assembly comprising:

means for mounting at least two filter assemblies with a filter housing having at least two filter mounting zones so as to define, in the aggregate, a filter assembly; and means for sealingly engaging said filter body relative to said filter housing in response to forces encountered by said filter assembly both dining assembly and in operation;

wherein said means for mounting comprises means for receiving filter elements and gaskets within a recessed area of a frame-like, one-piece molded member comprising said filter housing, including means for cooperatively interfitting with and bearing against edges of said gaskets opposite edges thereof bearing against said filter elements, and said filter housing, including means for surroundingly engaging said filter elements, said spacer and said small hole diffuser.

22. The assembly of claim 21 further including means for engaging and seating a peripheral flange of said coarse hole diffuser relative to a complementary peripheral flange portion of said filter housing.

23. A circuit breaker assembly comprising:

means for filtering a high energy arc comprising:

means for mounting at least two filter assemblies with a filter housing having at least two filter mounting zones so as to define, in the aggregate, a filter assembly;

means for sealingly engaging said filter body relative to said filter housing in response to forces encountered by said filter assembly both dining assembly and in operation;

means for assembling a small hole diffuser having a peripheral configuration similar to the peripheral configuration of said filter bodies in the aggregate, when assembled, with said filter housing and interfitting within said filter housing, superimposed over said filter assemblies;

means for interposing a spacer between said filters and said small hole diffuser; and means for engaging a molded coarse hole diffuser, defining a combined diffuser and spacer integrally molded as a single, one-piece unit, with said filter housing in close overlying engagement with said small hole diffuser; and means for diffusing said arc, comprising:

means for positioning and maintaining said arc stack and said filter assembly in assembled relation within said breaker housing, including maintaining compression on said gaskets and maintaining constant assembly force upon said assembly, equalizing compression loading of said gaskets and providing final positioning of the arc stack and filter assembly into the breaker case.

* * * * *